United States Patent [19]

Teague et al.

[11] 4,342,565

[45] Aug. 3, 1982

[54] BRUSHED STRETCH DENIM FABRIC AND PROCESS THEREFOR

[75] Inventors: Edward W. Teague, Raleigh; Max H. Hance, Coats; Carl R. Neal, Morresville, all of N.C.

[73] Assignee: Burlington Industries, Inc., Greensboro, N.C.

[21] Appl. No.: 251,702

[22] Filed: Apr. 6, 1981

Related U.S. Application Data

[62] Division of Ser. No. 68,277, Aug. 20, 1979, Pat. No. 4,283,194.

[51] Int. Cl.[3] ..... C09B 7/00; B32B 7/00

[52] U.S. Cl. ..... 8/532; 8/653; 428/91; 428/259

[58] Field of Search ..... 8/532, 653; 428/259

[56] References Cited

U.S. PATENT DOCUMENTS

| | | | |
|---|---|---|---|
| 2,404,837 | 7/1946 | Goldthwait | 8/117 |
| 3,486,208 | 12/1969 | Blythe | 428/230 |
| 3,516,896 | 6/1970 | Laurent | 428/259 |
| 3,604,470 | 9/1971 | Zindwer | 428/393 |

*Primary Examiner*—A. Lionel Clingman

*Attorney, Agent, or Firm*—Cushman, Darby & Cushman

[57] ABSTRACT

The invention concerns an improved stretch denim fabric dyed with hot indigo dye and strengthened by incorporating a filament filling yarn without obtaining whitening or crease wear problems. The invention also concerns a novel hot indigo dyeing process as well as an improved finishing process for this fabric.

26 Claims, No Drawings

BRUSHED STRETCH DENIM FABRIC AND PROCESS THEREFOR

This is a division of application Ser. No. 68,277 filed Aug. 20, 1979, now U.S. Pat. No. 4,283,194.

BACKGROUND OF THE PRESENT INVENTION

Denim fabrics are old and well known and are usually comprised of a firm twill-weave construction and usually are woven from 100% cotton yarns. Such fabric is characterized by having a whitish tinge which increases with wear that is obtained by using relatively white undyed filling yarns together with surface dyed or colored warp yarns and the twill construction is usually made with either a right hand or left hand twill. Standard denim fabrics are also usually blue in color which is achieved by using warp yarns that have been dyed with indigo dyes.

Indigo and the dyes resulting therefrom have been available for centuries and is a type of vat dye. While indigo dyes are normally water insoluble organic substances they can be reduced to a water soluble form and used to dye fabrics, and following dyeing the dye is oxidized which returns the dye to its water insoluble form on the yarn.

It has primarily been the use of indigo dyes and 100% cotton yarns that has given rise to the popularity of denim fabric today.

Denim fabric produced from 100% cotton yarns result in an esthetically pleasing fabric that exhibits good warp and filling tear strength. Denim fabrics that incorporate filament types of filling yarns would, of course, produce a much stronger fabric but produce whitening at the crease point under normal use because, such fabrics do not exhibit as good elbow/knee strength nor good flex abrasion strength as those that incorporate filament type filling yarns. Also, such fabrics can often exhibit too much warp or filling shrinkage. Further, the brushing of such fabrics can undesirably affect the color or shading of the fabric sometimes making the shade appear very uneven and does produce a weakening of the warp or filling yarns.

Part of these defects result from the use of standard indigo dyeing techniques. Indigo dyeing is usually carried out at room temperatures, normally from 70° F. to 90° F., and the dye does not usually penetrate through the whole yarn or fiber bundle notwithstanding that indigo dyeing is usually performed on wet fabrics. In fact, we have found that the wet nature of the yarn is detrimental to penetration. Accordingly, in regular indigo dyeing only the exterior layer of the yarn will have been dyed while the core of the indigo dyed yarns usually remain relatively undyed and this is referred to as ring dyeing. Thus, with wear, the shade of denim fabrics will lighten and the so called "washed" look will be achieved. It should also be pointed out that when polyester/cotton blended yarns are passed through an ordinary indigo dye bath, while the exterior portion of the cotton becomes dyed, the polyester remains undyed.

Various types of stretchable fabrics have been produced for many years and patented fabrics exemplary of such fabrics are described in the following U.S. Pat. Nos.: 246,024; 360,431; 1,601,484; 2,404,837; 3,369,281; 3,452,411; 3,486,208; 3,604,470 and 3,730,679. While these patents suggest ways to make cotton yarns stretchable, twill fabrics that exhibit warp stretch, fabrics where the stretch yarn can be included either in the warp of fill direction, improved selvages to anchor stretch yarns and stretch fabrics that can be comprised of a combination of natural and/or blended yarns none suggest the improved dyeing and finishing procedures forming part of our invention nor the resulting indigo dyed stretch denim fabrics.

Brushed, napped, scrubbed and sanded fabrics are also well known. The napping process usually involves the steps of running the cloth beneath or over a series of rollers covered with wire bristles or some abrasive surface with the rollers moving differentially with respect to cloth speed so that the rollers rub or brush against at least one side of the cloth. This brushing or napping operation raises the fibers on the surface of the cloth so that they stand up or are raised forming a nap or pile effect. In many instances, the brushing or napping process affects the filling yarns more than the warp yarns since warp yarns are usually more tightly twisted and, accordingly, it is unusual to find an indigo stretch denim fabric that has also been brushed. The brushing or napping process will, however, affect the warp yarns and it has been undesirable heretofore to nap or brush indigo dyed denim fabrics having filament filling yarns. To a degree this produces desirable results but when a filament is used as the fill yarn it would only serve to compound whitening problems which become apparent with the inclusion of the filament type of fill yarn. In fact, to limit the effects of abrasion on indigo dyed yarns, even where the use of such yarns will be in unbrushed fabrics, such yarns are frequently coated with an abrasion resistant coating, such as an acrylic, synthetic rubber or other polymeric coating, which will help prevent the wearing away of the dyed surface and the ultimate exposure of the relatively undyed core.

SUMMARY OF THE PRESENT INVENTION

The fabric according to the preferred embodiment of the present invention is a woven denim fabric having a twill construction. The warp yarn is preferably a cotton and polyester spun blend yarn comprised of 25% polyester and 75% cotton. However, other natural and synthetic fibers or blends thereof could also be used as the warp yarn. The fill yarn is preferably a stretch yarn and while there are a wide variety of stretch yarns that could be used, the preferred yarn is a textured, synthetic multifilament yarn. It is also preferred that this fill yarn be a relatively heavy yarn, for example, one having a denier ranging from about 400 to about 850 with the filaments therein varying from about 100 to about 250.

The wrap yarns are preferably dyed in a continuous manner either by slasher dyeing techniques, where a warp of 3,000 to 4,000 adjacent ends can be dyed simultaneously or by a long chain process where 300 to 400 individual ends are formed into a rope with 20 to 40 ropes thereafter being continuously passed through an appropriate dye range.

The yarns are initially scoured in a continuous scour at a temperature ranging from about 180° F. to about 210° F. and then washed or rinsed in a series of hot and cold water baths to remove any natural oils, waxes and any additives from earlier opening, blending, carding or spinning operations. Following this, the yarns are dried prior to passing into the indigo dye bath so that the precent of moisture is at or below normal again, such as about 2% to about 5% for a polyester/cotton blended yarn. We have found that in order to make the indigo dyed warp yarns capable of being brushed so that the denim fabric can be given a soft hand and simultaneously the "washed" look without significantly affecting the dyed quality of the warp yarns, it is important to have the indigo dye substantially penetrate through the yarn. One improved indigo dyeing process begins with yarns in a substantially dry condition, for example having a 2% to 5% moisture content and uses the indigo bath as the liquid that penetrates the dry yarn. The dryness of the yarn also aids in pulling the dye stuff into the yarn. In contrast with prior procedures this is a hot process in that the indigo bath is kept at a temperature ranging from about 130° F. to about 190° F., which is approximately twice the temperature range at which indigo dyeing is normally carried out. Secondly, the oxidation reduction potential of the indigo dye bath is initially raised to a relatively high state ranging from about 850 mv (millivolt) to about 1200 mv, and this level is maintained at a substantially constant level throughout the dyeing process. In addition, we have found it desirable, during dyeing, to continuously feed a mixture of completely reduced indigo, caustic and hydro to the dye bath in order to maintain the indigo concentration at a relatively constant level so that all the yarn is penetrated with substantially the same concentration of indigo dye and simultaneously to maintain that high oxidation reduction potential at a substantially constant level. By achieving these operating conditions in the indigo bath and keeping the dye bath at a temperature ranging from about 130° F. to about 190° F. it is possible to have the indigo dye substantially penetrate the warp yarn or fiber bundle.

When a polyester/cotton blended yarn is dyed with our improved indigo dyeing procedure, both the polyester and cotton portions are penetrated and dyed. The level of dyeing lessens toward the center of the yarn and there can be a relatively small core portion that only becomes tinted or stained but the dyeing results are quite different from those obtained from using normal indigo dyeing procedures. Also, while the shade of the polyester portion will be lighter than the cotton portion, the polyester portion is dyed with indigo dye. Thereafter, the indigo dye is oxidized either by "skying" the cloth, that is passing it through the air for a predetermined period of time, or chemically by the use of an oxygen donator such as peroxide. The yarns are then washed in a plurality of running washes ranging from about 140° F. to 180° F. followed by drying.

The dyed warp yarns and undyed stretch fill yarns are then woven under tension in the usual manner to form a fabric having a twill weave construction which can be, for example, a 3/1, 2/1 or a 2/2 twill pattern.

Following weaving, the fabric is washed, preferably in an open width manner, which helps to develop the stretch capability by permitting width-wise shrinkage. The fabric is then wet finished with or without a pigment or disperse dye added there to which when used will slightly stain the undyed fill yarns thereby reducing the contrast between the dyed warp yarns and the previously undyed fill yarns. This washing prepares the cloth for brushing and also serves to reduce the width of the fabric thereby developing the stretch, at least initially, in the filling yarn.

The fabric is treated to develop the stretch in the filling yarn and then compressively shrunk in the warp direction, brushed and then compressively shrunk again in the warp direction. It should be understood, however, that various combinations of the compressive shrinking and brushing steps can be used and it is not necessary that the fabric be shrunk prior to its being brushed. Likewise, the number of these cycles to which the fabric is subjected is variable.

Thus, the primary objective of the present invention is to produce a stretchable indigo dyed denim fabric that incorporates a filament filling yarn that strengthens the fabric and holds creases without objectionable whitening or wear point problems. Also, such a fabric can be brushed producing a very soft and pleasant hand without aggrevating such whitening or wear point problems. A further objective of the present invention is to produce a denim fabric that is much stronger than an all cotton fabric and in particular to produce a fabric that has much better tear strength in both the warp and fill directions as well as improved resistance to flex abrasion. By employing our hot indigo dyeing process, the warp yarns used in this fabric can be substantially penetrated by the indigo dye making them uniquely processable by brushing techniques allowing the production of a superior brushed denim stretch fabric.

DETAILED DESCRIPTION OF THE PREFERRED EMBODIMENT OF THE PRESENT INVENTION

Fabric Construction

The preferred embodiment of the present invention is a ten ounce stretch denim fabric produced from dyed warp yarns and undyed stretch fill yarns. It is preferred that the warp yarn be a polyester and cotton blend although other yarns, natural, synthetic or blends there of could be used. In particular, an 8.75/1 blended cotton/polyester yarn comprised of 25% Fortrel polyester ($2\frac{1}{4}$ denier$\times 1\frac{1}{2}$ inches staple length) and 75% carded cotton is preferred. The fill yarn is preferably a heavy denier yarn such as a 530/200 dull M9Q stretch polyester yarn manufactured by Monsanto that has been air textured and entangled. However, stretch yarns produced by false twisting and heat setting or any other known texturing technique could be used, it only being important to have the fabric stretchable between about 14% to about 22% in the filling direction.

During weaving, the fabric typically includes 3,888 warp ends woven with the stretch fill yarns in a 2/1 RH twill pattern producing a greige construction width of about $66\frac{1}{2}$ inches with about 59 ends and 35 picks per inch and a finished construction width of about 58 inches with 68 ends and 39 picks per inch.

Hot Indigo Dyeing

The present invention is illustrated, but not limited, by the following example of our improved indigo dyeing process.

As indicated above, we prefer to continuously dye yarns at a yarn speed of about 40 (YPM) yards per minute either by slasher dyeing 3,000–4,000 ends or by long chain dyeing, (i.e. rope dyeing) a plurality of ropes each comprised of about 300 to 400 individual ends.

Regardless of the form in which the yarns are dyed, the yarns will be initially scoured in a continuous scour. The scouring bath is an aqueous scouring solution comprised of four gallons of caustic, 20 pounds of a surfactant, such as synterge TER-1, 14 pounds of a chelating agent, such as Chelate No. 1, and enough water to bring the total volume to 310 gallons. This scouring bath is heated to a temperature ranging from about 180° F. to about 210° F. and preferably about 190° F. for about 5 to about 25 seconds.

Following scouring, the yarns are rinsed in a series of baths of hot running water ranging in temperature from 170° F. down to 130° F. to remove any natural oils and waxes or any additives from previous textile operations. The yarns are thereafter dried preferably by two sets of drying cans, the first set being held at approximately 240° F. while the second set is held at approximately 230° F. so that the yarn contains moisture at or below regain such as, for example, about 1% to about 6%. The dry yarn is then introduced directly into the indigo dye bath which is kept at a temperature approximately twice that normally used for indigo dyeing with the dye bath ranging in temperature from about 130° F. to about 190° F. and preferably being about 160° F.

The indigo dye bath can, for example, be prepared according to the followisng example wherein the indigo portion is made up of seven gallons of caustic, 30 pounds of dry hydrosulfite, 102 pounds of Indigo paste (20%), 10 pounds of a penetrant, such as Synterge TER-1 and enough cold water to bring the total volume to 267 gallons. This is mixed under cold conditions preferably not exceeding about 100° F. and is later brought up to the desired operating bath temperature.

The "hydro" portion of the dye bath is an aqueous solution of 22 gallons of caustic, 250 pounds of dry hydrosulfite and enough cold water to bring the total volume to 240 gallons. This hydro solution is also mixed under cold temperature conditions preferably not exceeding about 90° F. and when mixed with the indigo formulation described above, will produce a reduced indigo dye solution containing a completely reduced indigo, caustic and hydro having an oxidation reduction potential ranging from about 850 mv to 120 mv and preferably from about 950 mv to about 960 mv.

The dry warp yarns are fed directly into the hot indigo bath for an 8 second immersion period although immersion time must only be enough to have the dye solution penetrate the yarn. During dyeing the completely reduced indigo, caustic and hydro mixture is continuously fed to the indigo dye bath the indigo solution being fed at about 1.859 gallons per minute while the hydro portion is fed at about 0.65 gallons per minute (gpm). These feed rates are sufficient to maintain a substantially constant indigo concentration level in the bath and to simultaneously maintain the high oxidation reduction potential substantially at about 960 mv. This relatively high oxidation reduction potential maintains the equilibrium of the dye bath and assures that the indigo is kept in a properly reduced state at these extremely high operating temperatures.

The warp yarn makes single pass through this hot indigo bath and as previously indicated, remains immersed in the dye bath for approximately 8 seconds. Since the yarn entered the indigo bath dry, the bath itself acts to substantially penetrate the yarn. That, together with the highly reduced state of the indigo, unexpectedly allows the dye stuff to penetrate the yarn to a great degree than known heretofore, as well as the fiber bundles thereby producing a more penetrated dyed yarn.

Thereafter, the yarn is allowed to pass through the atmosphere or is "skyed" for approximately four minutes in order to complete reoxidizing the indigo. It should be understood, however, that the indigo could be chemically reoxidized by an oxygen donator such as peroxide if room were not available to allow the yarn to be fully skyed. Thereafter, the yarn is washed in three successive running washes ranging in temperatures from 80° F. to 140° F. with the yarn again being can dried to a moisture level at or less than normal regain at temperatures ranging from about 200° F. to about 250° F.

The resulting textile product dyed by this procedure will have the indigo dye penetrated more deeply into the fiber bundle and the yarns do not exhibit the usual ring dyed effect which occurs in regular indigo dyeings.

Finishing Procedures

Following the dyeing of the warp yarns and the weaving of the fabric, the resulting fabric must then be finished to produce a fabric which includes the brushed appearance, proper hand and the final finished stretch characteristics that are desired. Such finishing procedures are illustrated, but are not limited, by the following example. The fabric is first passed through a continuous open width washer. It should be understood that one of the primary functions of finishing procedures is to develop the latent stretch properties of the textured fill yarns. This can be accomplished by allowing the fabric to remain relaxed during washing or by placing additional tension in the warp direction. A J-Box would allow the fabric to be relaxed during the washing cycle while draw rolls or pull down rollers can be used to provide additional tension.

The fabric is passed through a series of wash boxes held at temperatures ranging from about 180° F. to about 210° F. each having a ph of about 10 or 11. The fabric moves at approximately 55 yards per minute through this series of wash boxes and thereafter the fabric is dried. Thereafter, a finish comprised of an aqueous solution of 50 lbs. of starch, 12 lbs. of non ionic detergent, 40 lbs. of Celca Set S-55E (PVA), 150 lbs. of a softener, 3 lbs. of blue pigment, Inmont Blue N2G and enough water to bring the volume to 300 gallons is applied to the fabric, with about a 60% pick-up rate. This serves to develop the desired fabric arsthetics as well as placing a tint on the filament filling yarns. The tint on the undyed filling yarns lessens or reduces the contrast that would otherwise be visible between the dyed warp yarns and the undyed fill yarns. Following the application of this finish, the fabric enters a tenter frame and a drying oven, which acts as a predryer, thereby drying the fabric at oven temperatures of about 325° F. The fabric continues to move at about 55 yards per minute through the drying oven and is left with a moisture content of about 3% to 8%. Upon leaving the dyring oven the fabric is mechanically stretched on a compressive shrinking machine to further activate the stretch in the fill yarn. The fabric is initially sprayed with cold water and then passed over a steam headed drying can supplied with 30 to 40 pounds of steam. Then the fabric passes into the compressive shrinkage unit comprised of an endless rubber belt which is positioned partially around a heated metal cylinder. The fabric then passes into a second portion of the compressive shrinking machine comprised of a cylinder around which an endless felt band is positioned. This later group is driven at a faster rate than the former so that as the fabric passes between these two portions of the compressive shrinking machine it is mechanically stretched about 0% to 5% thereby lessening the picks per inch in the greige fabric by about 1 to about 2 picks.

Then the fabric is subjected to at least one compressive shrinking cycle for shrinking the fabric in the warp direction. While this traditionally involves wetting the fabric and allowing it to shrink in a controlled manner under moderate heat conditions, the fabric is initially sprayed with a mixture of air and cold water spray, with the water at about 6 to 9 pounds pressure. The fabric then passes into a compressive shrinking machine and during which the fabric is compressively shrunk about 8 to about 10%. Fabric speed during this portion of the finishing process is approximately 56 yards per minute and the width is approximately 57½ inches. If a second shrinking process is desirable, the above compressive shrinking process is repeated.

The fabric is then passed through a scrubbing of brushing operation. The primary or warp face of the fabric is moved past a brushing roller or a roller covered with grit at a speed of approximately 30 yards per minute with the fabric under the full widthwise tension. Upon leaving the brushing operation the fabric can be subjected to a second brushing operation, substantially the same as the first except that we have found it preferable to increase fabric speed during the second brushing cycle to approximately 50 yards per minute while still holding the fabric under full tension. The term brushing is also understood in the trade to refer to scrubbing or sanding and is traditionally considered to involve the use of rotating brushes to raise a nap on an exterior face of the fabric. In both brushing sequences, only the exterior warp face of the fabric is brushed. The range of grit surfaces that can be used varies from about 24 about 220.

After the brushing operation, the fabric is again passed through another compressive shrinking sequence where shrinkage again occurs in the warp direction in the same manner as discussed above and occurs at a rate of approximately 2% to about 8% with a finished width of the fabric being about 57 to about 58 inches. The smoothness of the fabric face can be improved by inverting the fabric so that the fabric face lies against metal cylinders of the compressive shrinking machine.

Thus, by the above processing techniques, we have found it possible to produce a stretch denim fabric that combines the traditional denim esthetics associated with indigo dyed fabrics in a strengthened fabric obtained from the strengthened preformance capabilities of filament polyester. The resulting fabric also achieves an extremely soft hand. In addition, the resulting fabric is an indigo dyed product that can have an extremely soft brushed appearance as well as the simulation of the "washed" indigo appearance together with the low level of luster normally associated with a 100% cotton fabric. The fabric has an excellent recovery due to the incorporation of the textured synthetic filling yarn, extremely good crease retention, a uniform color and shade as well as a uniformally smooth surface. In addition, crease problems such as whitening have been substantially reduced because of the substantial penetration of the indigo dye within the warp yarns.

While the invention has been described in connection with what is presently concerned to be the most practical and preferred embodiment, it is to be understood that the invention is not to be limited to the disclosed embodiment but on the contrary, is intended to cover various modifications and equivalent arrangements included within the spirit and scope of the appended claims, which scope is to be accorded the broadest interpretation of such claims so as to encompass all such equivalent structures.

What we claim is:

1. A stretchable indigo dyed denim fabric comprised of hot indigo dyed warp yarns and textured stretch filling yarns wherein the warp yarn is selected from the group consisting of polyester and cotton blends, natural and synthetic yarns and blends of natural and synthetics.

2. An indigo dyed stretch denim fabric having a hot indigo dyed warp yarn and a textured filament yarn woven in a warp faced twill construction, the warp face having been brushed wherein the warp yarn is selected from the group consisting of polyester and cotton blends, natural and synthetic yarns and blends of natural and synthetics.

3. A denim fabric comprised of an indigo dyed warp yarn and a stretch fill yarn which fabric has been brushed following weaving.

4. A brushed stretch denim fabric composed of hot indigo dyed cellulose-containing warp yarns and textured filling yarns.

5. A fabric as in anyone of claims 1, 2, 3 or 4 wherein the warp yarn is a blended yarn.

6. A fabric as in anyone of claims 1, 2, 3 or 4 wherein the warp yarn is a polyester and cotton blended yarn.

7. A fabric as in anyone of claims 1, 2, 3 or 4 wherein the dye penetrates substantially throughout the warp yarn.

8. A fabric as in anyone of claims 1, 2, 3 or 4 wherein the warp yarn is a spun yarn.

9. A fabric as in anyone of claims 1, 2, 3 or 4 wherein the warp yarn is comprised of 25% polyester and 75% cotton.

10. A fabric as in anyone of claims 1, 2, 3 or 4 wherein the warp yarn is an 8.75 singles yarn.

11. A fabric as in anyone of claims 1, 2, 3 or 4 wherein the fill yarn is a synthetic stretch yarn.

12. A fabric as in anyone of claims 1, 2, 3 or 4 wherein the fill yarn is a textured polyester yarn.

13. A fabric as in claim 12 wherein the fill yarn has been bulked and air entangled.

14. A fabric as in claim 12 wherein the fill yarn has been false twisted and air entangled.

15. A fabric as in claim 11 wherein the fill yarn has been air entangled.

16. A fabric as in claim 4 wherein the fill yarn has a denier ranging from about 400 to about 850 and filaments ranging from about 100 to about 250.

17. A fabric as in claim 16 wherein the preferred denier is 530.

18. A fabric as in claim 4 wherein the fill yarn is a 530 denier yarn having about 200 filaments.

19. A fabric as in claim 4 wherein the fill yarn is a plied yarn.

20. A fabric as in claim 4 having about 14% to about 22% stretch in the fill direction.

21. A fabric as in claim 4 wherein the fabric is woven with a warp faced twill construction.

22. A fabric as in claim 21 wherein the twill construction is 3/1.

23. A fabric as in claim 21 wherein the twill construction is 2/1.

24. A fabric as in claim 21 wherein the twill construction is 2/2.

25. A fabric as in claim 3 wherein the fabric is woven with a warp faced twill construction.

26. A fabric as in claim 4 wherein the fill yarn is a 500/132 air entangled polyester yarn.

* * * * *